United States Patent [19]

Anderson et al.

[11] Patent Number: 5,025,970

[45] Date of Patent: Jun. 25, 1991

[54] PROTECTIVE SLEEVE FOR CARPET TACKING GUN

[75] Inventors: Martin L. Anderson, Maple Lake, Minn.; Gregory Nickel, Independence, Mo.

[73] Assignees: National Carpet Equipment Inc., Maple Grove, Minn.; National Carpet Equipment Inc., Maple Grove, Minn.

[21] Appl. No.: 496,239

[22] Filed: Mar. 20, 1990

[51] Int. Cl.[5] ..... B25C 7/26; B25C 7/36

[52] U.S. Cl. ..... 227/156; 150/55

[58] Field of Search ..... 227/156; 150/52 R, 55

[56] References Cited

U.S. PATENT DOCUMENTS 3,272,267 9/1966 Cangas ..... 227/156 X 4,946,087 8/1990 Wingert ..... 227/156 X 4,981,247 1/1991 Noll .

*Primary Examiner*—Timothy V. Eley

[57] ABSTRACT

A protective sleeve for a powered tacking machine is in the form of a single piece sleeve member formed of a resilient memoried polymeric material shape to encase the body of the stapler, has bottom and size openings to accommodate the stapling head and the handle of the stapling machine and a top opening to allow convection cooling of the body of the stapling machine. A further slit is provided connecting the side and bottom openings in said sleeve member such that the bottom portion of the sleeve member can be opened to accommodate placement on the machine, the material memory thereafter returning the material to its original shape on the tacking machine, such that no other means is required for retaining the sleeve member on the tacking machine.

10 Claims, 2 Drawing Sheets

PROTECTIVE SLEEVE FOR CARPET TACKING GUN

BACKGROUND OF THE INVENTION

I. Field of the Invention

The present invention is directed generally to improvements in powered carpet tacking guns, staplers or the like and, more particularly, to an improved protective sleeve to prevent the marring of surfaces addressed by the hard metallic housing surface of the gun.

II. Description of the Related Art

Electrically operated tacking guns or carpet staplers have been used for many years to shoot staples or tacks into material such as wood to retain pieces of carpet, or the like, in place. These devices are traditionally made of metal and include a rather heavy, generally cylindrical housing or body member located above the tack or staple outlet such that it is prone to bump walls, railing balusters, newels or other vulnerable items about which or next to which the carpet is to be installed. It has thus been necessary to be extremely careful when operating such a device in close proximity to items which are easily dented, scratched or marred. This is made particularly difficult inasmuch as these devices are prone to recoil to a certain extent when fired making them even more difficult to control in tight places.

Over the years, attempts have been to provide protective covers of one type or another over the housing member of the tacking gun to reduce or prevent marring of proximate surfaces. Such devices have reduced damage to such surfaces; however, since most are made of leather or fabric, or the like, they do cause an amount of scratching or denting. These covers also require straps, snaps or other devices to retain them in place on the tacker which sometimes get in the way and take additional time with regard to putting on and taking off of the protective devices. Because of this additional bother, they often are not used when they should be. Thus, there remains a need to provide a simple protective device for carpet tacking or stapling guns which prevents the marring of proximate surfaces and which can be readily be put on and taken off and can be retained without auxiliary fastening devices.

SUMMARY OF THE INVENTION

By means of the present invention, there is provided an improved protective sleeve for powered carpet tacking machines which is fabricated of a single piece of formed resilient memoried polymeric material shaped generally as a hollow cylinder to encase and match the body of the stapler. The sleeve member is provided with bottom and side openings to accommodate the stapling head and the handle of the stapling machine and has top and bottom openings to allow convection cooling of the body of the tacking machine. A slit connects the side and bottom openings in the one-piece sleeve so that the bottom portion of the sleeve can be opened to accommodate easy placement on the machine. The memory of the material returns it to the formed shape after installation on the machine and retains the sleeve in place until it is removed.

The molded sleeve of the present invention can be made from any of a class of moldable or dip formable, resilient polymeric materials which are memoried with respect to shape of formation such that, when deformed physically, they will return to the originally formed shape. The preferred material is a polyvinyl chloride polymer (PVC) which is heat curable on a preformed mandrel die and which has a hardness rating when cured of from about 80 Durometer to 100 Durometer. A hardness of about 90 Durometer has been found to be the most successful.

BRIEF DESCRIPTION OF THE DRAWINGS

In the drawings wherein like numerals are directed to depict like parts throughout the several views.

DESCRIPTION OF THE PREFERRED EMBODIMENT

The protective sleeve of the invention is particularly characterized by its simplicity including ease of application and removal and the very protective and non-marring nature of the materials of construction The sleeve will prevent scratching or marring of surfaces addressed by the tacking machine though they be struck or rubbed repeatedly by the sleeve in the course of fastening carpets around stair balusters and newels, in attaching upholstery to fine furniture, or other difficult or hard to reach carpet-wood or carpet-wall or furniture upholstery interfaces.

Figure 1:
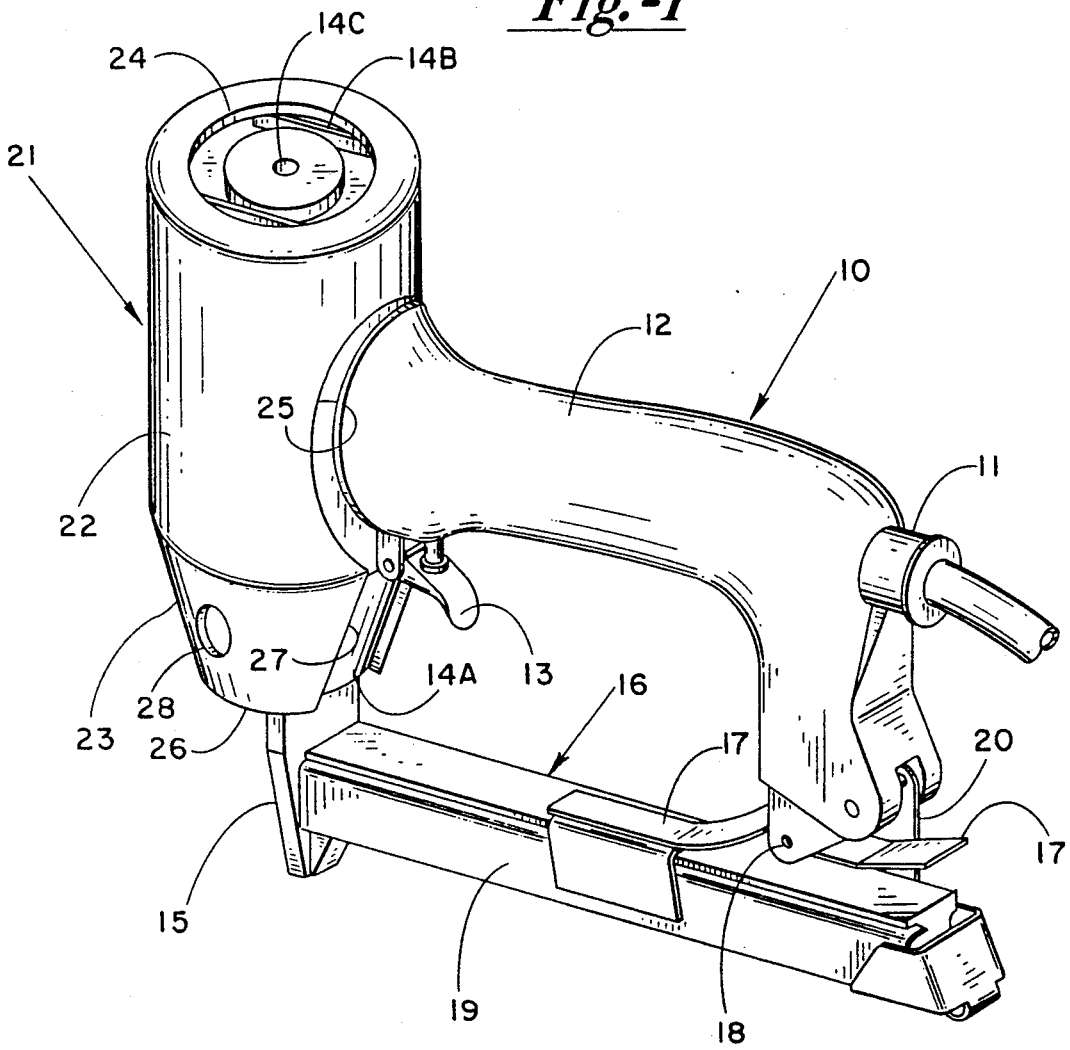
FIG. 1 is a perspective, elevational view of an electrically powered tacking or stapling machine equipped with the protective sleeve of the invention.
Figure 2:
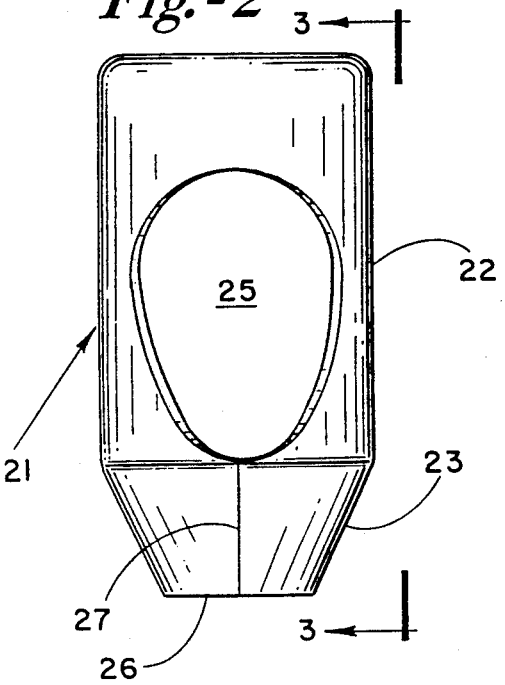
FIGS. 2–6 are, respectively, front, side, top, bottom and vertical sectional views of one embodiment of the protective sleeve of the invention.
Figure 3:
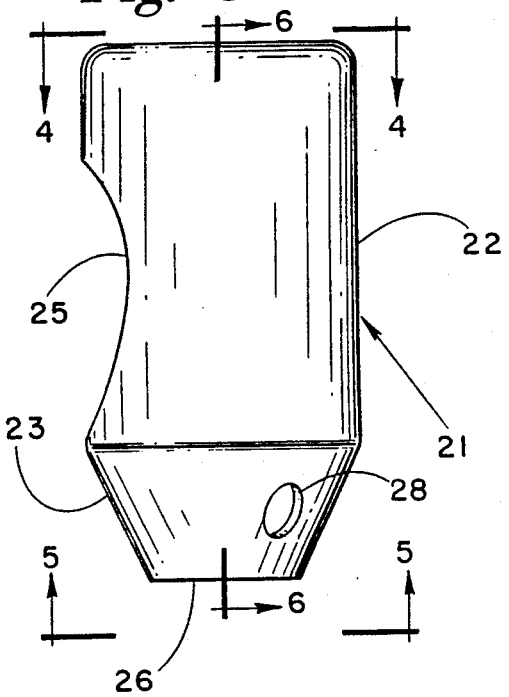
Figure 4:
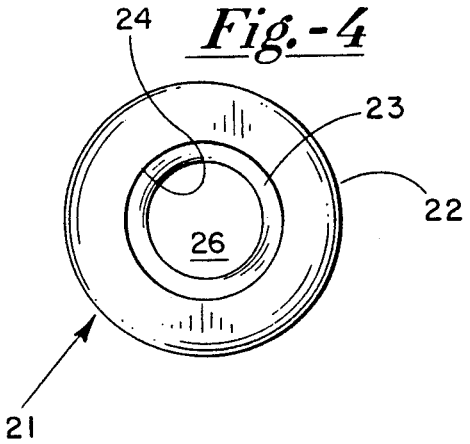
Figure 5:
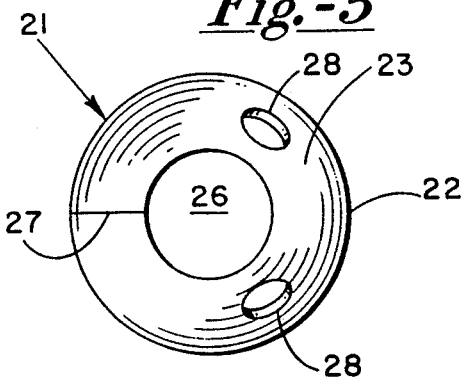
Figure 6:
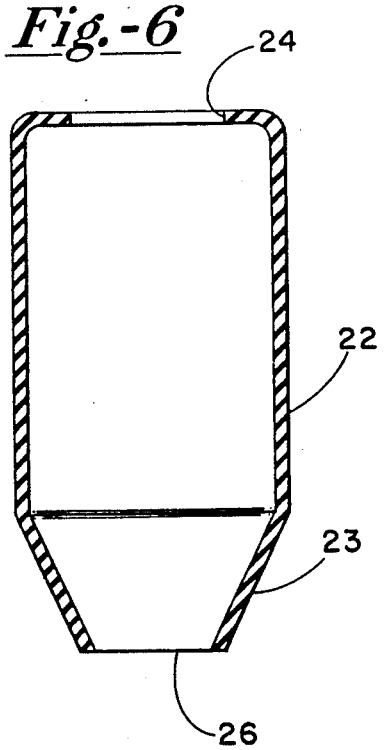

A typical protective sleeve fabricated in accordance with the invention is shown as being carried on a hand held electrically operated stapling or tacking machine in FIG. 1. The tacking machine is depicted generally at 10 and includes an electrical input connection depicted by 11, a generally cylindrically shaped handle portion 12, and a trigger mechanism for operation by the index finger of the operator at 13. The tack or staple firing mechanism is housed in a heavy metal, generally cylindrical housing or body member which includes a conical lower portion 14A which fires tacks or staples through a metal ejector nozzle 15. The housing member further has outer top cooling fins as at 14B and a heat dissipating hole 14C. Staples or tacks to be installed by the tacker machine are carried in a reloadable magazine 16 which is held closed by a leaf spring 17 operating against a shaft or pin member 18. When the leaf spring 17 is depressed a cover member 19 is released and slides away from the nozzle 15 to allow additional staples to be placed in the magazine after which the cover can be reset. The staple magazine is attached to the nozzle 15 and also to the handle of the gun 10 as by a flange member 20.

The sleeve or protective jacket is depicted as being mounted about the housing member generally at 21. As better illustrated in views 2–6, the sleeve 21 has a generally thin-walled hollow shape defining a volume having a configuration generally matching that of the tacker or staple gun body or housing. This includes a generally cylindrical upper section 22 and a generally conical lower portion 23 which respectively address and generally match the outer surface of the housing including the conical segment 14A. Vent openings to promote cooling of the housing are provided in the top and bottom of the sleeve as shown at 24 and 28, respectively. Vent 24 is shown as a round opening but can be any other convenient shape. A further side opening 25 is provided to accommodate the handle of the stapler and a bottom hole 26 to accommodate the end of the conical section 14A containing the staple firing nozzle. A slit is provided connecting openings 25 and 26 in the material of the sleeve at 27. This allows the bottom portion to be open or peeled back and the entire sleeve readily slipped onto the housing member. Upon release, it returns to its original shape and retains itself in position as further discussed below.

In accordance with the present invention the sleeve member 21 is fabricated from a soft, pliable resilient material which does not mar wood and can be used near polished wood or even fine furniture. Wallboard or other common materials of finished room construction are also quite safe. In addition the sleeve must be fabricated of a material from a class which exhibit shape memory. These materials return to their molded, dipped or otherwise formed original shapes after being distorted. When the sides of the sleeve 21 are opened up to accommodate the body or housing member and the sleeve is thereafter released, it immediately returns to its molded shape, i.e., assumes the shape of original formation which, in this case, is the shape of the member which it was designed to cover or accommodate.

There is a class of polymeric materials which exhibit properties which are desirable for the sleeve of the invention and these include polyvinyl chloride (PVC). PVC is obtainable in a variety of heat curable hardnesses. The sleeves of the invention have been found to work very well using PVC polymers which have a hardness rating from about 80 Durometer to about 100 Durometer. Although polymers outside of this range of hardnesses might find a use in the sleeve of the invention, it has been found that PVC of less than about 80 Durometer is generally too pliable to be self-sustaining on the tacking machines and PVC polymer of a Durometer hardness greater than 100 is more difficult to work with and loses the desired resiliency. The higher hardness also may mar some surfaces. The best results have been obtained using a heat curable PVC polymer having a hardness rated at about 90 Durometer.

While the sleeves of the invention may be made in several ways including all types of heated molding operations including injection, vacuum molding, pour-molding or even heated extrusion, they are preferably dip coated on shaped mandrels. In the preferred process, the PVC material is provided in a liquid form at approximately room temperature in the form of a PVC liquor. Preformed mandrel dies in the shape of the tacker body member are preheated to a predetermined, desired temperature and thereafter dipped into the PVC liquor. When the mandrels are withdrawn, a coating of a desired thickness, depending on the temperature of the heated mandrel, and the speed with which it is withdrawn from the liquor is formed on the mandrel which is in the shape desired, the material conforming precisely to the die. This thickness may be controlled by varying the temperature of the dipped mandrel until the desire thickness is obtained. While this will vary with the desired resiliency and the hardness of the PVC material used, successful embodiments have been made in which the protective sleeves of the invention are from about 0.10 to about 0.20 inch thick. The formed, cured and cooled sleeves are readily peeled off the mandrels and the openings 24 and 25 thereafter provided.

Whereas the protective sleeve of the present invention has been particularly illustrated and described with respect to its placement on the body of a powered carpet tacking or stapling device, it is understood that this embodiment is designed to be illustrative only and by no means limiting with respect to the scope of the invention. It will be appreciated, of course, that those skilled in the art may depart from the specific design arrangements set forth herein without departing from the spirit and scope of the present invention.

What is claimed is:

1. A protective sleeve for a powered stapling machine having a generally cylindrical body, a stp ling head connected to the bottom end of the body, and a handle connected to the side wall of the body, comprising:

a unitary sleeve member formed of a resilient memoried polymeric material shaped generally as hollow cylinder to encase, and prevent marring of surfaces contacted by, the body of the powered tacking machine, the sleeve member further having spaced bottom and side openings to accommodate the stapling head an the handle of the stapling machine and a top opening to allow convection cooling of the body of the stapling machine;

wherein a further slit is provided connecting the side and bottom openings in the sleeve member such that the bottom portion of the sleeve member can be opened or spread to enable and accommodate placement of the sleeve on the machine;

wherein the memory of the material thereafter returns the sleeve to its original shape on the stapling machine; and wherein no other means is provided for retaining the sleeve member on the tacking machine.

2. The protective sleeve of claim 1 wherein the sleeve member is made substantially of heat-curable polyvinyl chloride polymer.

3. The protective sleeve of claim 2 wherein the sleeve member has a hardness in the range of approximately 80 and 100 Durometer.

4. The protective sleeve of claim 3 wherein the hardness is approximately 90 Durmoeter.

5. The protective sleeve of claim 4 wherein the sleeve member has a nominal thickness from about 0.10 to about 0.20 inches.

6. The protective sleeve of claim 4 wherein the sleeve member has a nominal thickness from about 0.14 to about 0.16 inches.

7. The protective sleeve of claim 3 wherein the sleeve member has a nominal thickness from about 0.10 to about 0.20 inches.

8. The protective sleeve of claim 3 wherein the sleeve member has a nominal thickness from about 0.14 to about 0.16 inches.

9. The protective sleeve of claim 1 wherein the sleeve member has a hardness in the range of approximately 80 to 100 Durometer.

10. The protective sleeve of claim 1 wherein the sleeve member has a nominal thickness from about 0.10 to about 0.20 inches.

* * * * *

UNITED STATES PATENT AND TRADEMARK OFFICE

CERTIFICATE OF CORRECTION

PATENT NO. : 5 025 970

DATED : June 25, 1991

INVENTOR(S) : Martin L. Anderson, et al.

It is certified that error appears in the above-identified patent and that said Letters Patent is hereby corrected as shown below:

In column 4, line 14, "stp ling" should read -- stapling -- .

In column 4, line 20, after "as", insert -- a -- .

Signed and Sealed this

Thirteenth Day of October, 1992

*Attest:*

DOUGLAS B. COMER

*Attesting Officer*

*Acting Commissioner of Patents and Trademarks*